US009335133B2

(12) United States Patent
Yamamoto

(10) Patent No.: US 9,335,133 B2
(45) Date of Patent: May 10, 2016

(54) IGNITER ASSEMBLY, METHOD OF ASSEMBLING SAME AND COVER MEMBER

(71) Applicant: Daicel Corporation, Osaka-shi, Osaka (JP)

(72) Inventor: Koji Yamamoto, Tatsuno (JP)

(73) Assignee: DAICEL CORPORATION, Osaka-Shi, Osaka (JP)

( * ) Notice: Subject to any disclaimer, the term of this patent is extended or adjusted under 35 U.S.C. 154(b) by 0 days.

(21) Appl. No.: 13/939,732

(22) Filed: Jul. 11, 2013

(65) Prior Publication Data

US 2014/0013981 A1 Jan. 16, 2014

Related U.S. Application Data

(60) Provisional application No. 61/671,616, filed on Jul. 13, 2012.

(30) Foreign Application Priority Data

Jul. 13, 2012 (JP) ..... 2012-157619

(51) Int. Cl.

| | |
|---|---|
| ***F42B 3/10*** | (2006.01) |
| ***F42B 3/195*** | (2006.01) |
| ***F42B 3/12*** | (2006.01) |
| ***F42B 3/198*** | (2006.01) |

(52) U.S. Cl.

CPC . *F42B 3/10* (2013.01); *F42B 3/125* (2013.01); *F42B 3/195* (2013.01); *F42B 3/198* (2013.01); *Y10T 29/49117* (2015.01)

(58) Field of Classification Search

USPC ..... 102/202.5, 202.7–202.12, 202.14, 102/275.11, 530; 29/825

See application file for complete search history.

(56) References Cited

U.S. PATENT DOCUMENTS

| | | | | |
|---|---|---|---|---|
| 1,856,642 | A * | 5/1932 | Karollus | 102/202.8 |
| 2,987,997 | A | 6/1961 | Ireland, Jr. | |
| 4,271,453 | A * | 6/1981 | Yajima et al. | 361/248 |

(Continued)

FOREIGN PATENT DOCUMENTS

| | | |
|---|---|---|
| CN | 1235668 A | 11/1999 |
| EP | 1 621 413 A1 | 2/2006 |

(Continued)

OTHER PUBLICATIONS

International Search Report issued in International Application No. PCT/JP2013/068318 on Oct. 1, 2013.

(Continued)

*Primary Examiner* — Bret Hayes

(74) *Attorney, Agent, or Firm* — Birch, Stewart, Kolasch & Birch, LLP

(57) ABSTRACT

An igniter assembly includes, an igniter main body integrated with a resin portion. The igniter main body includes, a metallic header having an electro-conductive pin, a metallic cup covering the metallic header so as to form a charging space, and an ignition agent charged within the charging space. The igniter assembly further includes, a cover member covering the metallic cup, the cover member being provided with a reinforcing rib at least on an inner circumferential surface of a peripheral wall thereof, and the resin portion surrounds at least a portion of the peripheral wall of the cover member, a portion of the metallic header, and the electro-conductive pin.

11 Claims, 5 Drawing Sheets

(56) References Cited

U.S. PATENT DOCUMENTS

| | | | | |
|---|---|---|---|---|
| 4,278,025 | A * | 7/1981 | McReynolds | 181/116 |
| 4,592,280 | A * | 6/1986 | Shores | 102/202.2 |
| 4,615,271 | A * | 10/1986 | Hutchinson | 102/318 |
| 5,131,679 | A | 7/1992 | Novak et al. | |
| 5,403,036 | A * | 4/1995 | Zakula et al. | 280/741 |
| 5,762,370 | A * | 6/1998 | Lindsey et al. | 280/741 |
| 5,932,832 | A * | 8/1999 | Hansen et al. | 102/202.4 |
| 5,988,069 | A | 11/1999 | Bailey | |
| 6,009,809 | A * | 1/2000 | Whang | 102/202.7 |
| 6,073,963 | A * | 6/2000 | Hamilton et al. | 280/741 |
| 6,079,332 | A | 6/2000 | Marshall et al. | |
| 6,295,935 | B1 * | 10/2001 | Swann et al. | 102/530 |
| 6,311,621 | B1 | 11/2001 | Marshall et al. | |
| 6,526,890 | B1 * | 3/2003 | Vidot et al. | 102/202.12 |
| 6,851,372 | B2 * | 2/2005 | Bender et al. | 102/530 |
| 2002/0069782 | A1 * | 6/2002 | Avetisian et al. | 102/202.7 |
| 2004/0226472 | A1 | 11/2004 | Oda | |
| 2006/0017269 | A1 | 1/2006 | Kuroda et al. | |
| 2006/0260498 | A1 | 11/2006 | Hatomoto | |
| 2008/0148983 | A1 | 6/2008 | Oda | |
| 2008/0156216 | A1 | 7/2008 | Yoshida et al. | |
| 2010/0181748 | A1 | 7/2010 | Nakamura et al. | |
| 2010/0186615 | A1 * | 7/2010 | Kodama et al. | 102/530 |
| 2010/0313783 | A1 * | 12/2010 | Hansen | 102/202.8 |
| 2012/0000387 | A1 * | 1/2012 | Nance et al. | 102/202.9 |
| 2012/0192748 | A1 * | 8/2012 | Scheid et al. | 102/275.11 |

FOREIGN PATENT DOCUMENTS

| | | | |
|---|---|---|---|
| JP | 2003-161599 | A | 6/2003 |
| JP | 2005-249275 | A | 9/2005 |
| JP | 2005-308339 | A | 11/2005 |
| JP | 2006-035970 | A | 2/2006 |
| JP | 2006-284151 | A | 10/2006 |
| WO | WO 2008/153097 | A1 | 12/2008 |

OTHER PUBLICATIONS

Du, Zhimin, Editor, "Die Design—Examples of UGNX4 in Chinese Edition," 1st Edition, Jan. 2008, 8 pages, with a partial English translation.

Luo, Xiaoye, Editor, "Plastics Molding Process and Die Design," 1st Edition, Jan. 2006, pp. 22-26 (10 pages total), with a partial English translation.

* cited by examiner

IGNITER ASSEMBLY, METHOD OF ASSEMBLING SAME AND COVER MEMBER

This nonprovisional application claims priority under 35 U. S. C. §119(a) to Patent Application No. 2012-157619 filed in Japan on 13 Jul. 2012 and 35 U. S. C. §119(e) to U.S. Provisional application No. 61/671,616 filed on 13 Jul. 2012, which are incorporated by reference.

BACKGROUND OF INVENTION

1. Field of Invention

The present invention relates to a cover member for an igniter to be used in a gas generator for a restraining device such as an airbag system of a vehicle. It also relates to an igniter assembly using the same, and an assembling method of the igniter assembly.

2. Description of Related Art

An igniter is used for a gas generator or an actuator for activating a restraining device such as an airbag.

In the case of an electrical-type igniter, an ignition agent is filled in a metallic cup. Thus, for the purpose of insulation, a plastic insulation cover is put on the outside of the cup.

The insulation cover has an aim of insulation, and hence may be thin. However, too small thickness results in an insufficient strength, so that the insulation cover tends to be deformed. This leaves room for improvement in terms of the assembling workability.

U.S. Pat. No. 5,131,679 discloses an igniter assembly 140. A metallic cap 158 for use in the igniter assembly 140 is covered with a thin plastic film 170. The thickness of the plastic film 170 is 0.125 mm (in column 6, lines 17-18). With this plastic film, the metallic cap 158 is kept in an electrically insulated state.

SUMMARY OF INVENTION

The present invention provides an igniter assembly, including:

an igniter main body, integrated with a resin portion, the igniter main body including:

a metallic header having an electro-conductive pin;

a metallic cup covering the metallic header so as to form a charging space, an ignition agent charged within the charging space; and a cover member covering the metallic cup, the cover member being provided with a reinforcing rib at least on an inner circumferential surface of a peripheral wall thereof:

the igniter assembly including the resin portion surrounding at least a portion of the peripheral wall of the cover member, a portion of the metallic header, and the electro-conductive pin.

The present invention provides a method for assembling the igniter assembly of the present invention, including steps of:

placing the cover member on a stand such that an opening thereof is directed upwardly;

fitting the metallic cup of the igniter main body into the cover member from an opening side thereof; and providing the resin portion, wherein when the metallic cup is fitted into the cover member, while bringing the reinforcing rib on the inner circumferential surface of the cover member and an outer circumferential surface of the metallic cup into contact with each other, fitting is performed with a gap formed between the outer circumferential surface of the metallic cup and the inner circumferential surface of the cover member.

The present invention provides a cover member for an electrical insulation, used for the above shown, including:

a cup-like shaped cover member including a bottom surface and the peripheral wall provided with the reinforcing rib extending longitudinally in the axis direction, the igniter assembly including an igniter main body including:

the metallic header having the electro-conductive pin, the metallic cup covering the metallic header so as to form the charging space, and the ignition agent charged within the charging space, wherein the cover member covers the metallic cup.

The present invention provides a cover member for an electrical insulation for covering the metallic cup of the above defined igniter assembly.

BRIEF DESCRIPTION OF THE DRAWINGS

The present invention will become more fully understood from the detailed description given hereinbelow and the accompanying drawings which are given byway of illustration only, and thus are not limitative of the present invention and wherein.

DETAILED DESCRIPTION OF INVENTION

Figure 1:
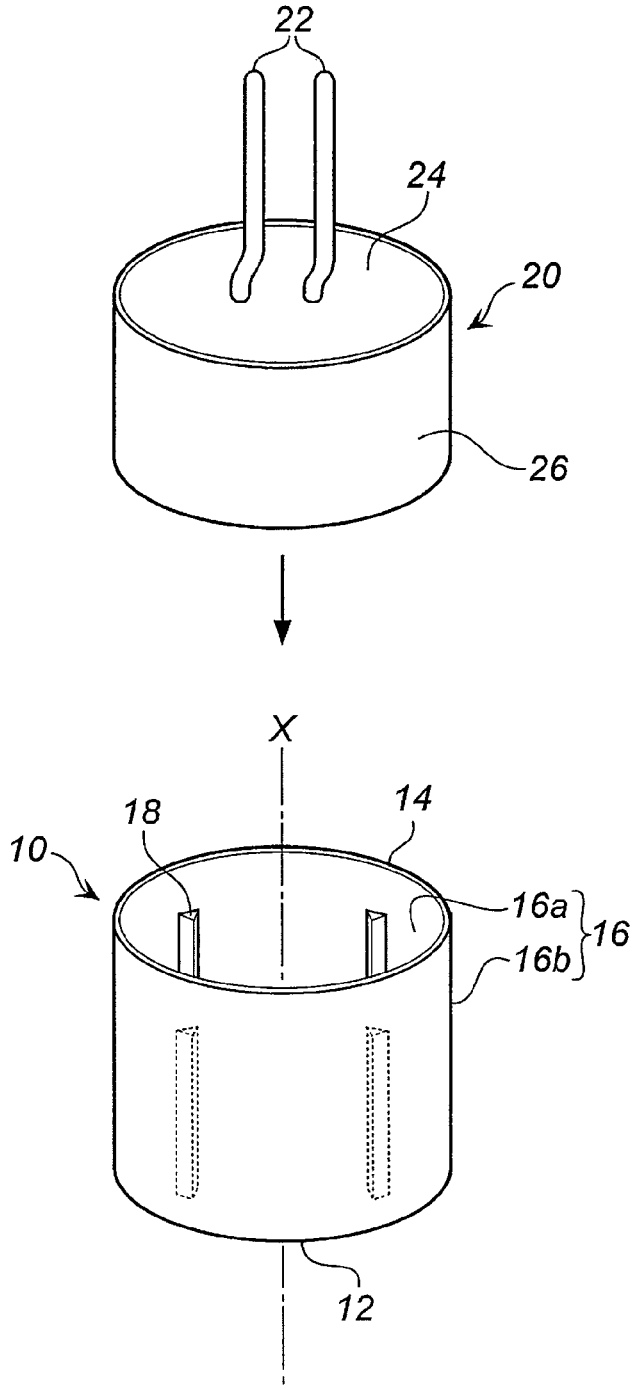
FIG. 1 shows a perspective view of a cover member, and a perspective view for illustrating the fitting operation of the cover member to a metallic cup of an igniter.

The present invention provides a cover member which is to be put on a metallic cup of an igniter main body, has a small wall thickness with a sufficient strength and is capable of improving the assembly workability.

The present invention also provides an igniter assembly using the cover member.

Further, the present invention also provides an assembling method of the igniter assembly.

The cover member of the present invention has a function of electrically insulating the metallic cup by being put on the outside of the metallic cup. For this reason, the cover member can be manufactured from a material having an electrically insulating characteristic. Various resins (e.g., paragraph No. 0020 of JP-A No. 2003-161599), rubbers, elastomers, and the like can be used. For example, Nylon 66, Nylon 6-12, and fluorine resin can be used.

The cover member of the present invention is in a cup-like shape having a bottom surface and a peripheral wall, and has a reinforcing rib on the peripheral wall.

The shape and the internal volume of the cover member are a shape and an internal volume which allow the cover member to be put on the metallic cup.

It can also be configured as follows: when the cover member is formed of a material having elasticity, the cover member is made smaller than the metallic cup; and the cover member is put (fitted) on the metallic cup, while being stretched.

Further, the bottom surface of the cover member may be a closed surface, or may have a single small hole or a plurality of small holes.

Each reinforcing rib is formed by partially increasing the wall thickness of the peripheral wall in the cover member, and extends in the axial direction (longitudinal direction) of the cover.

The cross-sectional shape of the reinforcing rib in the width direction can be a semi-circle, a triangle, a tetragon, a trapezoid, or the like.

The thickness (the maximum thickness) of the reinforcing rib is set to be 1.05 to 4 times, preferably 1.5 to 3.5 times, and further preferably 2 to 3 times the thickness of the peripheral wall (a portion including no reinforcing ribs formed thereon) of the cover member.

The thickness (the maximum thickness) of the reinforcing rib is the thickness between the base and the apex (the thickness also including a portion corresponding to the peripheral wall), for example, when the cross-sectional shape in the width direction is a triangle.

The thickness of the peripheral wall (a portion including no reinforcing rib formed thereon) of the cover member can be set 0.1 to 0.3 mm, and is preferably 0.15 to 0.2 mm.

The reinforcing rib is formed on the inner surface or the outer surface of the peripheral wall, or on both surfaces thereof.

One or a plurality of reinforcing rib(s) may be provided. In order to enhance the reinforcing effect, provision of a plurality of reinforcing ribs is preferable.

When a plurality of reinforcing ribs are provided, the number of equidistantly disposed ribs is preferably 3 to 8, more preferably 3 to 6, and further preferably 3 to 4.

Whereas, the reinforcing ribs may be equidistantly formed in 3 to 8 groups, preferably 3 to 6 groups, and more preferably 3 to 4 groups with a plurality of ribs as one group.

When the reinforcing ribs are provided on both of the inner surface and the outer surface of the peripheral wall, the ribs may be formed at the same positions on the inner side and the outer side, or may be formed at different positions.

For example, when four reinforcing ribs are equidistantly formed on the inner surface, it can be configured such that, on the outer surface, each of the four reinforcing ribs is formed at respective intermediate positions in the circumferential direction between neighboring two of the four ribs on the inner surface.

The reinforcing ribs are formed within the any region between the position of the peripheral wall of the cover member in contact with the bottom surface and the opening thereof.

The reinforcing rib can be formed to be:

the one formed continuously over the entire region between the bottom surface and the opening;

the one formed continuously over the region between the bottom surface and the vicinity of the opening;

the one formed continuously over the region between the vicinity of the bottom surface and the opening; and the one formed continuously over the region between the vicinity of the bottom surface and the vicinity of the opening (i.e., the intermediate region except for the opposite end sides).

The reinforcing rib is preferably in a continuous shape, but may be formed of a plurality of separate parts.

The cover member has the reinforcing ribs as described above. Thereby, even when a load is applied to the peripheral wall from the axial direction, or from the radial direction, the peripheral wall is less likely to be deformed. Accordingly, the shape of the cover member is kept.

This leads to better workability when the cover member is fitted to the metallic cup of the igniter main body.

It is preferable in the igniter assembly of the present invention that, in the cover member, the reinforcing rib includes a plurality of reinforcing ribs equidistantly formed on the inner circumferential surface, the outer circumferential surface or both of the inner circumferential surface and the outer circumferential surface of the peripheral wall.

The reinforcing ribs are formed on the inner surface, the outer surface, or both of the inner surface and the outer surface of the cover member.

In the cover member including the reinforcing ribs formed on the inner circumferential surface of the peripheral wall thereof, there is formed an air vent gap between the inner circumferential surface of the peripheral wall including no reinforcing ribs thereon and the metallic cup. This facilitates the fitting operation to the metallic cup. Also after fitting, it results that the reinforcing ribs press the peripheral wall of the metallic cup from outside, which provides the advantageous effect of making the cover member less likely to be removed.

The cover member, provided with the reinforcing ribs on the outer circumferential surface of the peripheral wall thereof is assembled in an igniter assembly having a resin portion in which a part of the metallic header (a metallic cup) of the igniter main body is covered with a resin. In this case, part of each reinforcing rib of the cover member is also covered with a resin (is embedded in a resin), thereby obtaining such an advantageous effect that the cover member is prevented from rotating in the circumferential direction.

The cover member including reinforcing ribs formed on both the inner circumferential surface and the outer circumferential surface of the peripheral wall thereof can provide both the foregoing advantageous effects.

It is preferable in the igniter assembly of the present invention that, in the cover member, a bottom surface of the cover member includes a concave portion recessed inwardly at a central part thereof, an annular surface around the concave portion, and an inclined surface extending between the concave portion and the annular surface.

The cover member is manufactured by injection-molding a resin into the space formed by a die (a combination of a male die and a female die).

At this step, the injection-molding is performed such that the injection gate of the resin is situated at a portion corresponding to the central part of the bottom surface of the cover member.

Then, when the cover member is taken out from the die after injection molding, a small protrusion is formed by injection of the resin from the injection gate at the center of the bottom surface (a portion corresponding to the injection gate).

If the protrusion remains as it is, the protrusion tilts or shakes the cover member when the cover member is placed on a stand such that the bottom surface faces downward. This results in the degradation of the fitting workability.

Such a problem is resolved if the protrusion is removed. However, the operation of removing the protrusion itself becomes a burden, resulting in the degradation of the workability.

The bottom surface of the cover member of the present invention includes a concave portion recessed inwardly at the central part thereof, an annular surface around the concave portion, and an inclined surface extending between the concave portion and the annular surface.

For this reason, even when a small protrusion is formed at the concave portion, the concave portion is in a recessed state, and the annular surface therearound is higher. Accordingly, even when the cover member is placed on a stand such that the bottom surface faces downward, the cover member does not shake or tilt even with the presence of the protrusion. For example, the concave portion can be formed in the shape of a circle, and the inclined surface can be formed in the shape of a ring.

The height of the protrusion formed by injection-molding can be confirmed in advance. Accordingly, by adjusting the height of the protrusion, and the difference in height between the concave portion and the annular surface, it is possible to obtain such an advantageous effect that the cover member with the protrusion is not shaken on a stand and does not cause the degradation of the fitting workability.

In the igniter assembly of the present invention, a part of the outer circumferential surface, on the opening side, of the cover member is surrounded by (embedded in) the resin portion. With this, the cover member itself is preferably prevented from falling off.

It is preferable in the igniter assembly of the present invention that:

the cover member further has reinforcing ribs on an outer circumferential surface of the peripheral wall, and part of the outer circumferential surface, on the opening side, of the cover member including the reinforcing ribs is surrounded by a resin portion.

In the igniter assembly of the present invention, when the cover member, further provided with reinforcing ribs on the outer circumferential surface of the peripheral wall in addition to the inner circumferential surface as shown above, is used, with part of the reinforcing ribs surrounded and embraced by the resin portion, such advantageous effects are preferably obtained that the cover member is prevented from falling off and that the cover member is prevented from rotating in the circumferential direction.

The igniter assembly of the present invention can be manufactured by injection-molding a resin for forming the resin portion, after putting the cover member on the metallic cup of the igniter main body.

As described above, use of the cover member of the present invention facilitates the fitting operation of the cover member to the metallic cup.

The resin portion of the igniter assembly may be formed of the same resin as that of the cover member, or may be formed of a different resin.

As to the resin portion, when a resin, having the same melting point as that of the resin forming the cover member, is used for the resin portion and the resin portion covers part of the cover member by injection-molding, the cover member and the resin portion are molten and integrated with each other. As a result, the bonding strength can be more enhanced.

As to the cover member into which the metallic cup of the igniter main body is fitted, when the cover member, provided with reinforcing ribs at least on the inner circumferential surface of the peripheral wall, is used, the outer circumferential surface of the metallic cup and the reinforcing ribs of the cover member come in contact with each other.

This results in at least the formation of gaps continuous in the axial direction (the region between the bottom surface and the opening of the cover member) between the cover member and the metallic cup at circumferentially both sides of each reinforcing rib.

Accordingly, in the process of fitting the metallic cup into the cover member, the gaps serve as air vent holes. This facilitates the fitting operation.

When no gap is formed and the entire outer circumferential surface of the metallic cup and the entire inner circumferential surface of the cover member are in contact with each other at the time of fitting the metallic cup into the cover member, the internal air cannot be vented. This makes the fitting operation difficult, which may result in the deformation of the cover member itself.

The cover member for the cup for the igniter main body of the present invention has a reinforcing rib, and hence is less likely to be deformed. For this reason, the fitting workability to the metallic cup member of the igniter main body is good.

Figure 2:
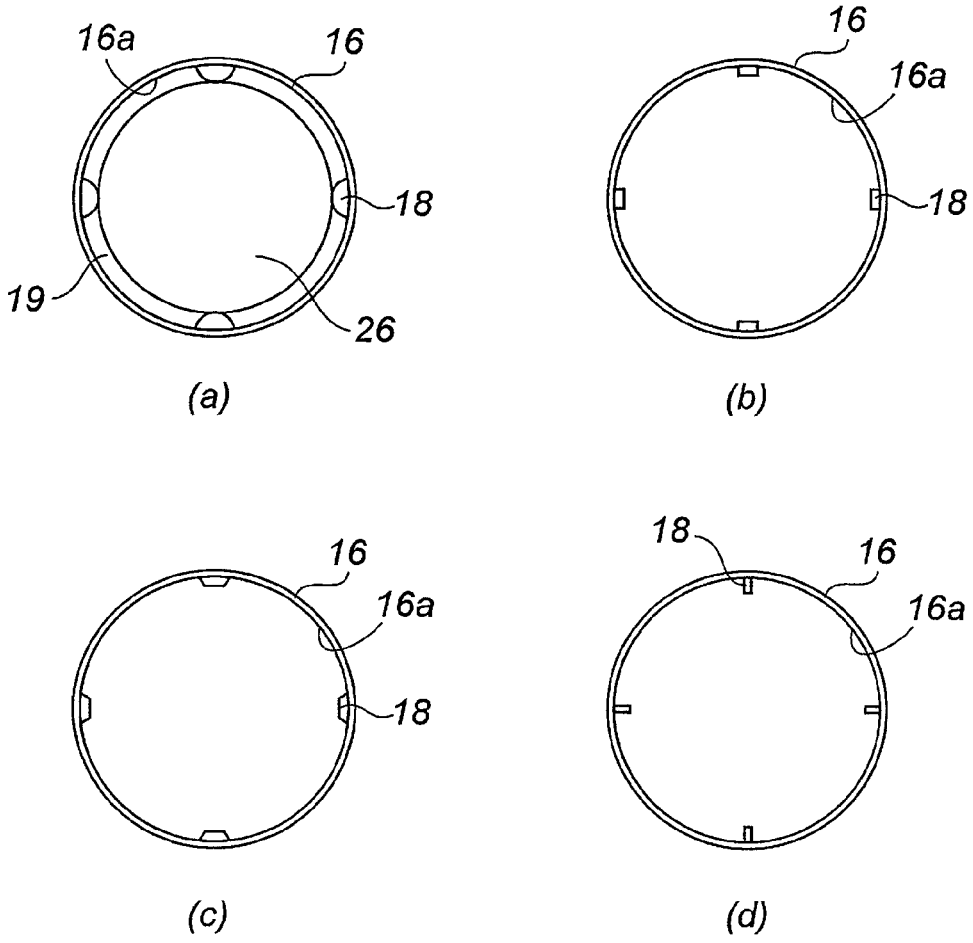
FIG. 2, in (a) to (d), shows cross-sectional views in the width (diameter) direction of cover members of different embodiments.
Figure 3:
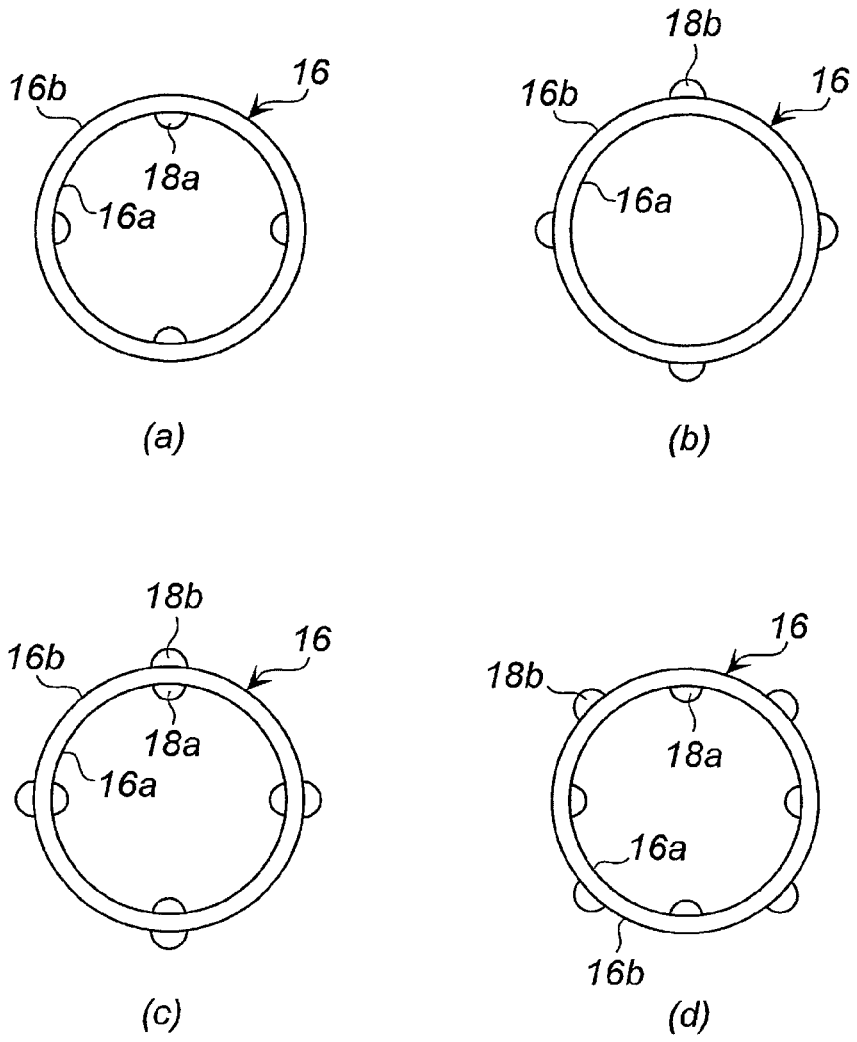
FIG. 3, in (a) to (d), shows cross-sectional views in the width (diameter) direction of cover members of different embodiments.

DESCRIPTION OF EMBODIMENTS (1) Cover members of FIGS. 1 to 3

A cover member 10 shown in FIG. 1 has a bottom surface 12 and a peripheral wall 16, is in the shape of a cup, and is formed of Nylon 6-12.

On an inner circumferential surface 16*a* of the peripheral wall 16, four reinforcing ribs 18 extending in the direction of X axis are formed equidistantly from one another in the circumferential direction.

The four reinforcing ribs 18 are each formed so as to be at a position at a little distance from the bottom surface 12 at one end thereof, and to be at a position at a little distance from an opening 14 at the other end thereof.

The wall thickness of the peripheral wall 16 is 0.18 mm. The maximum thickness (including the thickness of the peripheral wall 16) of the reinforcing rib 18 is 0.2 mm.

The cross-sectional shape in the width direction of the reinforcing rib 18 has no particular restriction. The cross-sectional shape can be formed in, for example, the triangle shown in FIG. 1, the semi-circle shown in (a) in FIG. 2, the tetragon shown in (b) in FIG. 2, the trapezoid shown in (c) in FIG. 2, or the rectangle shown in (d) in FIG. 2.

Incidentally, (a) in FIG. 2 shows together the positional relationship when a metallic cup 26 is fitted.

The reinforcing ribs 18 can be formed on any of the inner circumferential surface 16*a* and the outer circumferential surface 16*b* of the peripheral wall 16, or both thereof.

In (a) in FIG. 3 (as with (a) in FIG. 2), four reinforcing ribs 18 are formed equidistantly in the circumferential direction on the inner circumferential surface 16*a* of the peripheral wall 16.

In (b) in FIG. 3, four reinforcing ribs 18 are formed equidistantly in the circumferential direction on the outer circumferential surface 16*b* of the peripheral wall 16.

In (c) in FIG. 3, respective four reinforcing ribs 18*a* and 18*b* are formed equidistantly in the circumferential direction at the same positions on both the inner circumferential surface 16*a* and the outer circumferential surface 16*b* of the peripheral wall 16, respectively.

In (d) in FIG. 3, respective four reinforcing ribs 18*a* and 18*b* are formed equidistantly in the circumferential direction at different positions on both the inner circumferential surface 16*a* and the outer circumferential surface 16*b* of the peripheral wall 16, respectively. Each of the four outer ribs 18*b* is formed so as to be at the intermediate position between the inner ribs 18*a*.

In actual manufacturing, a large number of cover members 10 are manufactured, and stored and transported in a packaged form.

In this case, the laterally adjacent or vertically stacked cover members 10 may press and deform the peripheral wall 16.

Unless the insulating function is impaired even when deformation is caused, the cover member 10 is usable. However, the cover member 10 becomes less likely to be fitted to the metallic cup 26, resulting in the degradation of the workability.

The cover member 10 of the present invention has the reinforcing ribs 18. As a result, even when a load is imposed on the cover member 10, the peripheral wall 16 is inhibited from being deformed. Accordingly, the workability is not impaired.

Then, the fitting operation of the cover member 10 to the metallic cup 26 of the igniter main body 20 will be described by reference to FIG. 1.

The igniter main body 20 has a known structure, in which the metallic cup 26 is fixed to a metallic header 24 including electro-conductive pins 22 fixed therein with a known method such as welding.

As shown in FIG. 1, the metallic cup 26 of the igniter main body 20 is fitted into the cover member 10 placed on a stand such that an opening 14 is directed upwardly (see (a) in FIG. 2).

At this step, if the cover member 10 is deformed or tilted, the fitting operation of the igniter main body 20 becomes difficult.

However, the cover member 10 becomes less likely to be deformed by the reinforcement effect of the reinforcing ribs 18. Accordingly, the fitting workability is not impaired.

Incidentally, from the viewpoint of enhancing the fixing strength of the cover member 10 to the metallic cup without impairing the fitting workability, it is preferable to adjust the dimensions of the cover member 10 and the metallic cup 26 of the igniter main body 20.

When each cover member 10 shown in FIG. 1 and (a) to (d) in FIG. 2 is used, in the state before being put on the metallic cup 26, the adjustment is preferably performed so that the relationship between the distance (w1) between the reinforcing ribs 18 opposing each other in the cover member 10, the inside diameter (r1) of the peripheral wall 16 having no reinforcing ribs, and the outside diameter (D1) of the metallic cup 26 is r1>D1>w1. Incidentally, when the reinforcing ribs 18 are not at facing positions, the diameter of the circle formed by connecting the inner ends of the reinforcing ribs 18 is referred to as w1.

By satisfying such a relationship, the metallic cup 26 can be fitted while being press-fitted to the reinforcing ribs 18 of the cover member 10.

However, as shown in (a) in FIG. 2, even at this step, the contact area between the metallic cup 26 and the reinforcing ribs 18 is small, and the gap 19 at which the inner circumferential surface 16*a* of the peripheral wall 16 and the metallic cup 26 are not in contact with each other serves as an air vent hole. Accordingly, the fitting operation can be carried out smoothly.

Incidentally, in actuality, it is difficult that the gap 19 in a perfect circle as shown in (a) in FIG. 2 is formed. However, at least gaps are formed in the vicinity of the reinforcing ribs 18, and hence these serve as air vent holes. In some cases, holes can also be formed in the bottom surface 12.

Then, after completion of fitting, it results that the reinforcing ribs 18 and the cup 26 are in intensive contact with each other. Accordingly, the cover member 10 becomes less likely to come off from the metallic cup 26.

Figure 4:
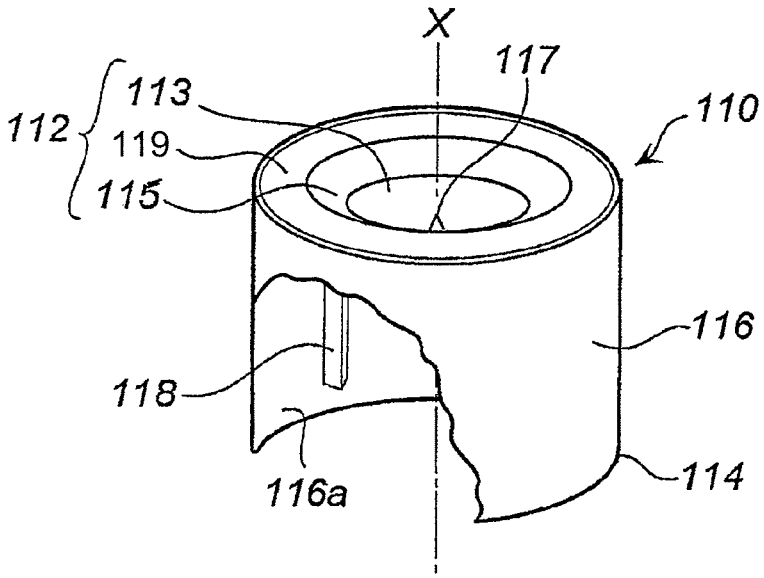
FIG. 4 shows a perspective view of a cover member of a different embodiment.

(2) Cover Member of FIG. 4

FIG. 4 shows a cover member 110 of another embodiment, and shows the cover member 110 with the bottom surface 112 side up, contrary to the cover member 10 of FIG. 1, in a partially cutaway state for understanding of the inside.

The cover member 110 is in the shape of a cup having a bottom surface 112 and a peripheral wall 116.

On an inner circumferential surface 116*a* of the peripheral wall 116, four reinforcing ribs 118 extending in the direction of X axis are formed equidistantly from one another in the circumferential direction.

The four reinforcing ribs 118 are each formed so as to be at a position at a little distance from the bottom surface 112 at one end thereof, and to be at a position at a little distance from an opening 114 at the other end thereof.

The bottom surface 112 includes an circular concave portion 113 recessed inwardly at the central part thereof, an annular surface 119 around the circular concave portion, and an annular inclined surface 115 extending between the circular concave portion 113 and the annular surface 119.

The circular concave portion 113 is formed concentrically with the central axis X.

The circular concave portion 113 recesses inwardly, so that the annular inclined surface 115 is an inclined surface descending from the annular surface 119 side toward the circular concave portion 113 side.

Then, a protrusion 117 derived from the manufacturing step is formed at the central part of the circular concave portion 113.

The protrusion 117 has a smaller height than the difference between the height of the annular surface 119 and the height of the circular concave portion 113, whose apex is hence at a lower position than that of the annular surface 119.

For this reason, even when the cover member 110 is placed on a stand as with the cover member 10 shown in FIG. 1, only the annular surface 119 comes in contact with the stand, and the protrusion 117 does not come in contact therewith. Accordingly, the cover member 110 is not shaken.

Figure 5:
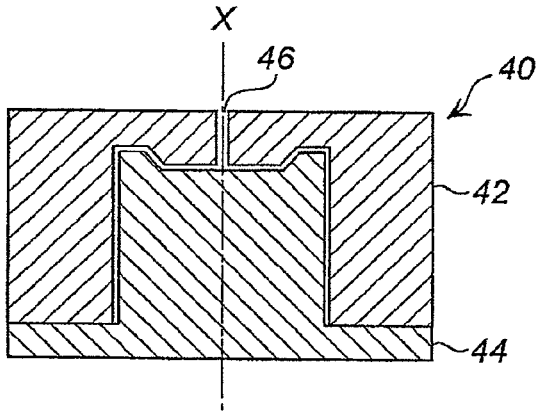
FIG. 5 is an explanatory view of a manufacturing method of the cover member in FIG. 4.

Then, a molding method of the cover member 110 of FIG. 4 will be described by reference to FIG. 5.

A molding die (die) 40 includes an upper die (female die) 42 and a lower die (male die) 44. Joining of both the dies 42 and 44 results in the formation of a space (a resin filling space) in the shape in agreement with that of the cover member 110.

When injection molding is performed, a molten resin is injected from an injection gate 46 into the resin filling space.

Then, after curing of the resin, the dies are separated from each other, and a molded product (the cover member 110) is taken out. At this step, the resin remaining in the gate 46 is left, being deposited on the cover member 110, thereby the protrusion 117 is formed.

When the several hundreds, thousands, or even millions of cover members 110 are manufactured, removal of the protrusions 117 on a one-by-one basis largely impairs the workability. However, by forming the bottom surface 112 of the cover member 110 as shown in FIG. 4, such a problem is prevented from occurring.

Figure 6:
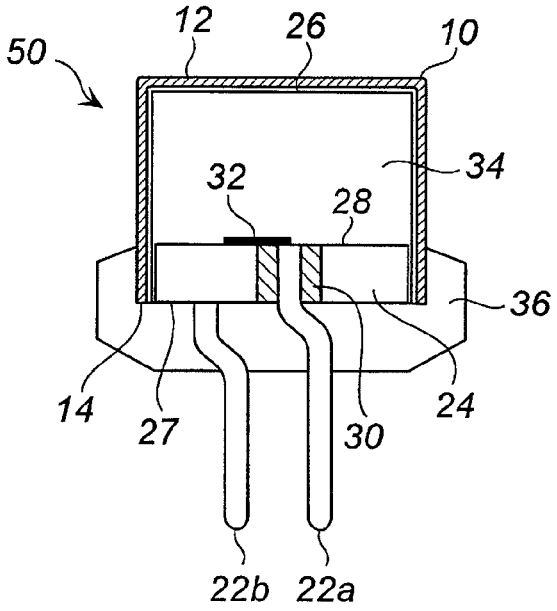
FIG. 6 is a cross-sectional view in the axial direction of an igniter assembly.

(3) Igniter Assembly of FIG. 6

An igniter assembly 50 of FIG. 6 has the igniter main body 20 (the reference sign is omitted in FIG. 6) shown in FIG. 1, and the resin portion 36.

The igniter main body 20 includes a combination of the following parts.

The metallic header 24 has a hole at the central part thereof, to which a center pin (one of the electro-conductive pins) 22*a* is mounted via an insulator 30 such as glass.

An earth pin (the other electro-conductive pin) 22*b* is connected to the bottom surface 27 of the metallic header 24.

On the top surface 28 side of the metallic header 24, a bridge wire 32 is disposed in such a manner as to be cross-linked between the center pin 22*a* and the top surface 28 of the metallic header 24.

The metallic cup 26 is put on the top surface 28 of the metallic header 24. An ignition agent 34 is filled in the internal space so as to be in contact with the bridge wire 32.

The cover member 10 having four reinforcing ribs in the inside thereof is put on the metallic cup 26 from the top of the metallic cup 26, as shown in FIG. 1.

The resin portion 36 integrated with the igniter main body 20 covers the bottom surface 27 of the metallic header 24, portions of the center pin 22*a* and the earth pin 22*b*, and further, the opening side of the cover member 10 on the metallic cup 26.

As the resin for forming the resin portion 36, there can be used the same one as the resin usable as the manufacturing material for the cover member 10. However, when a resin is used as the manufacturing material for the cover member 10, use of the same resin, or a resin having the same level of melting point can melt the opening 14 side of the cover member 10, and can integrate the opening 14 side thereof with the resin portion 36. Accordingly, this is preferable for air-tightly keeping the metallic cup 26 and the metallic header 24.

Other than the igniter assembly 50 shown in FIG. 6, also acceptable is, for example, the igniter assembly obtained by injection molding the resin 3 to the igniter collar 2 as shown in FIG. 1 of JP-A No. 2003-161599. Similarly, the cover member of the present invention can be mounted to the ignition portion 4.

(4) Assembling Method of Igniter Assembly

An assembling method of the igniter assembly 50 will be described by reference to FIG. 1.

On a worktable, the cover member 10 is placed so that the opening 14 faces upward.

In this state, the metallic cup 26 of the igniter main body 20 is fitted into the cover member 10 from above. As the cover member 10, for example, each one as shown in (a) to (d) in FIG. 2 is used.

When the metallic cup 26 is fitted into the cover member 10, the outer circumferential surface of the metallic cup 26 comes in contact with the reinforcing ribs 18 of the cover member 10. Then, the gap 19 as shown in (a) in FIG. 2 is obtained between the outer circumferential surface of the metallic cup 26 and the inner circumferential surface (the surface including no reinforcing ribs 18 formed thereon) 16*a* of the cover member 10.

The cover member 10 itself is very thin. Accordingly, in actuality, the gap 19 with the shape as shown in (a) in FIG. 2 is not obtained. Thus, it results that the outer circumferential surface of the metallic cup 26 and the inner circumferential surface (the surface including no reinforcing ribs 18 formed thereon) 16*a* of the cover member 10 are partially in contact with each other.

However, there is a difference between the thickness of each reinforcing rib 18 and the thickness of the inner circumferential surface (the surface including no reinforcing ribs 18 formed thereon) 16*a* of the cover member 10. This results in at least the formation of gaps continuous in the axial direction on circumferentially both sides of each reinforcing rib 18.

For this reason, between the outer circumferential surface of the metallic cup 26 and the inner circumferential surface 16*a* of the cover member 10, there are formed the gaps 19 continuous in the axial direction (the region between the bottom surface and the opening of the cover member). The gaps 19 serve as air vent holes, which facilitates the fitting operation.

After fitting the metallic cup 26 of the igniter main body 20 into the cover member 10, the resin portion 36 is formed by applying an injection molding method, thereby obtaining the igniter assembly 50.

Even when the cover member 110 shown in FIG. 4 is used in place of the cover member 10, the assembling method and the advantageous effects resulting therefrom are the same as with the case using the cover member 10.

With the igniter assembly using the cover member 110, upon completion of assembly thereof, an annular gap is formed between the bottom surface (the top surface) of the metallic cup 26 and the annular surface 119 of the cover member 110.

However, the annular gap itself is very small, and hence, does not become an obstacle for other components even when the igniter assembly is mounted to, for example, a gas generator for an airbag.

The annular gap can also be crushed, if required. Incidentally, even when the protrusion 117 remains, it does not become a problem after manufacturing the igniter assembly. Further, so long as the protrusion 117 does not protrude from the annular surface 119, the circular concave portion 113 and the annular inclined surface 115 may be respectively in other shapes than a circular shape and an annular shape. And, the reinforcing ribs 18 and 118 each have a function of reinforcing the respective peripheral walls 16 and 116 of the cover members 10 and 110. Accordingly, so long as the reinforcing ribs 18 and 118 each have the functions, the shape and specifications of the reinforcing ribs are not limited to the above embodiments.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An igniter assembly, comprising:

an igniter main body, integrated with a resin portion, the igniter main body including:

a metallic header having an electro-conductive pin;

a metallic cup covering the metallic header so as to form a charging space, an ignition agent charged within the charging space; and a cover member covering the metallic cup, the cover member having an electrically insulating characteristic and being provided with first reinforcing ribs on an inner circumferential surface of a peripheral wall thereof, each of the first reinforcing ribs partially increasing a wall thickness of the peripheral wall and extending in an axial direction of the cover member and including an apex that determines a maximum thickness of each of the first reinforcing ribs, in a height direction of each of the first reinforcing ribs, that presses against an outer circumferential surface of the metallic cup, the height direction being a radius direction of the cover member, the igniter assembly including the resin portion surrounding at least a portion of the peripheral wall of the cover member, a portion of the metallic header, and the electro-conductive pin.

2. The igniter assembly according to claim 1, wherein the cover member is further provided with second reinforcing ribs on an outer circumferential surface of the peripheral wall thereof, and a portion of the outer circumferential surface, in a side of an opening of the cover member, including the second reinforcing ribs is surrounded by the resin portion.

3. The igniter assembly according to claim 1, wherein, in the cover member, the first reinforcing ribs are equidistantly formed on the inner circumferential surface, and second reinforcing ribs are equidistantly formed on an outer circumferential surface of the peripheral wall of the cover member.

4. The igniter assembly according to claim 1, wherein, a bottom surface of the cover member includes a concave portion recessed inwardly at a central part thereof, an annular surface around the concave portion, and an inclined surface extending between the concave portion and the annular surface.

5. A method of assembling the igniter assembly according to claim 1, comprising:

preparing the cover member having the first reinforcing rib, the first reinforcing rib preventing the cover member from deforming before being fitted to the metallic cup member;

placing the cover member on a stand such that an opening thereof is directed upwardly;

fitting the metallic cup of the igniter main body into the cover member from an opening side thereof; and providing the resin portion, wherein when the metallic cup is fitted into the cover member, while bringing the first reinforcing ribs on the inner circumferential surface of the cover member and an outer circumferential surface of the metallic cup into contact with each other, fitting is performed with a gap formed between the outer circumferential surface of the metallic cup and the inner circumferential surface of the cover member.

6. A cover member for an electrical insulation, used for the igniter assembly according to claim 1, further comprising:

a cup-like shaped cover member including a bottom surface and the peripheral wall provided with the first reinforcing ribs extending longitudinally in the axis direction, the igniter assembly including an igniter main body including:

the metallic header having the electro-conductive pin, the metallic cup covering the metallic header so as to form the charging space, and the ignition agent charged within the charging space, wherein the cover member covers the metallic cup.

7. The igniter assembly according to claim 1, further comprising:

a second reinforcing rib formed on an outer circumferential surface of the peripheral wall of the cover member.

8. The igniter assembly according to claim 1, wherein an outer circumferential surface of the metallic cup and an inner circumferential surface of the cover member extending between adjacent first reinforcing ribs are partially in contact with one another at a contact portion, and the outer circumferential surface of the metallic cup and the inner circumferential surface of the cover member define a first gap, extending in the axial direction of the cup member, between one of the adjacent first reinforcing ribs and the contact portion, and a second gap, extending in the axial direction, between another one of the adjacent first reinforcing ribs and the contact portion.

9. The igniter assembly according to claim 1, wherein an amount of increase in the thickness of the peripheral wall, in the radius direction of the cover member, that forms each of the first reinforcing ribs is smaller than a thickness, in the radius direction, of the peripheral wall without the increased wall thickness.

10. An igniter assembly, comprising:

an igniter main body, integrated with a resin portion, the igniter main body including:

a metallic header having an electro-conductive pin;

a metallic cup covering the metallic header so as to form a charging space, an ignition agent charged within the charging space; and a cover member covering the metallic cup, the cover member having an electrically insulating characteristic and being provided with a first reinforcing rib on an inner circumferential surface of a peripheral wall thereof, the first reinforcing rib partially increasing a wall thickness of the peripheral wall and extending in an axial direction of the cover member and including an apex that determines a maximum thickness of the first reinforcing rib, in a height direction of the first reinforcing rib, that presses against an outer circumferential surface of the metallic cup, the height direction being a radius direction of the cover member, the igniter assembly including the resin portion surrounding at least a portion of the peripheral wall of the cover member, a portion of the metallic header, and the electro-conductive pin.

11. The igniter assembly according to claim 10, wherein an amount of increase in the thickness of the peripheral wall, in the radius direction of the cover member, that forms each of the first reinforcing ribs is smaller than a thickness, in the radius direction, of the peripheral wall without the increased wall thickness.

* * * * *